US012678649B2

(12) United States Patent
Lin

(10) Patent No.: US 12,678,649 B2
(45) Date of Patent: Jul. 14, 2026

(54) RESISTANCE UNIT AND EXERCISE MACHINE HAVING THE SAME

(71) Applicant: Tsung-Chou Lin, Tainan City (TW)

(72) Inventor: Tsung-Chou Lin, Tainan City (TW)

( * ) Notice: Subject to any disclaimer, the term of this patent is extended or adjusted under 35 U.S.C. 154(b) by 85 days.

(21) Appl. No.: 18/658,525

(22) Filed: May 8, 2024

(65) Prior Publication Data

US 2025/0325861 A1 Oct. 23, 2025

(30) Foreign Application Priority Data

Apr. 18, 2024 (TW) ..... 113114515

(51) Int. Cl.
*A63B 21/005* (2006.01)
*A63B 21/00* (2006.01)

(52) U.S. Cl.
CPC ..... *A63B 21/0056* (2013.01); *A63B 21/0058* (2013.01); *A63B 21/153* (2013.01)

(58) Field of Classification Search
CPC ..... A63B 21/153; A63B 21/0058; A63B 51/0056
See application file for complete search history.

(56) References Cited

U.S. PATENT DOCUMENTS 5,879,276 A * 3/1999 Miller ..... A63B 22/18 482/131
7,087,001 B1 * 8/2006 Ihli ..... A63B 21/015 D30/153
8,622,879 B1 * 1/2014 Ihli ..... A63B 21/4015 482/127
2003/0153441 A1 * 8/2003 Berns ..... A63B 21/00069 482/124
2019/0344123 A1 * 11/2019 Rubin ..... A63B 21/153
2021/0394010 A1 * 12/2021 Hansen ..... A63B 21/025
2022/0001240 A1 * 1/2022 Rubin ..... A63B 24/0087
2023/0149761 A1 * 5/2023 Bhargava ..... F16F 15/12 482/1
2023/0201652 A1 * 6/2023 Ye ..... A63B 21/153 482/133
2023/0405404 A1 * 12/2023 Belsham ..... A63B 21/0058
2024/0278063 A1 * 8/2024 Simenthi ..... A63B 21/0054
2025/0001232 A1 * 1/2025 Gregory ..... A63B 21/153
2025/0090886 A1 * 3/2025 Simenthi ..... H02K 7/116
2025/0090887 A1 * 3/2025 Simenthi ..... A63B 21/155
(Continued)

FOREIGN PATENT DOCUMENTS

CN 215461707 U * 1/2022
DE 4404261 A1 8/1995
DE 202007009543 U1 6/2008
(Continued)

*Primary Examiner* — Joshua T Kennedy
(74) *Attorney, Agent, or Firm* — Rosenberg, Klein & Lee

(57) ABSTRACT

A resistance unit and an exercise machine having the same are disclosed. The resistance unit includes a body, a power-driven resistance unit, a reel, and a cable. The power-driven resistance unit is fixed to the body. The reel is connected to an output shaft of the power-driven resistance unit. The reel is rotated along with the output shaft. The power-driven resistance unit gives a rotational resistance to the reel. The cable is connected to and coiled around the reel. The exercise machine includes at least one exercise machine frame. The resistance unit is detachably connected to the exercise machine frame.

14 Claims, 9 Drawing Sheets

(56) References Cited

U.S. PATENT DOCUMENTS

| | | | | | |
|---|---|---|---|---|---|
| 2025/0090893 | A1* | 3/2025 | Simenthi | ..... | A63B 21/4035 |

FOREIGN PATENT DOCUMENTS

| | | | | | |
|---|---|---|---|---|---|
| DE | 602005003729 | T2 | | 12/2008 | |
| DE | 202020106146 | U1 | | 1/2021 | |
| DE | 202020005886 | U1 | | 3/2023 | |
| EP | 3182575 | B1 | | 6/2017 | |
| KR | 102899352 | B1 | * | 12/2025 | ..... A63B 22/203 |
| TW | M633954 | U | | 11/2022 | |
| TW | 1811099 | B | | 8/2023 | |
| TW | M651551 | U | | 2/2024 | |
| WO | 2023139409 | A1 | | 7/2023 | |

* cited by examiner

RESISTANCE UNIT AND EXERCISE MACHINE HAVING THE SAME

FIELD OF THE INVENTION

The present invention relates to a resistance unit and an exercise machine having the same. The resistance unit can be used alone for fitness purposes and can be mounted on any exercise machine.

BACKGROUND OF THE INVENTION

In general, an exercise machine is equipped with a resistance unit to provide a rotational resistance during training, so that the user can choose different resistances for training according to different training modes.

As disclosed in Taiwan Utility Model Patent No. M633954 on Nov. 11, 2022, a rowing exercise machine comprises a base frame, a paddle unit, a first rotating shaft, a paddle linkage unit, a resistance unit, a pull bar unit, a second rotating shaft, and a pull bar linkage unit. When a first operating force is applied to the paddle unit, a paddle one-way driving wheel and the first rotating shaft are driven to rotate in a first rotational direction. When the first operating force decreases or disappears, the paddle one-way driving wheel is idling on the first rotating shaft in a second rotational direction. When a second operating force is applied to the pull bar unit, the pull bar linkage unit is driven to rotate in the first rotational direction. When the second operating force decreases or disappears, a second return force drives a pull bar one-way wheel to be idling on the second rotating shaft in the second rotational direction. In this way, the rowing exercise machine can be operated in different exercise modes through the paddle unit and the pull bar unit.

In the above-mentioned patent, the resistance unit is disposed on the base frame and cannot be mounted and dismounted at will. Besides, the resistance unit is not compatible with other rowing exercise machines of different specifications or other types of exercise machines.

A multifunctional recumbent exercising device is disclosed, including a base frame, a first transmission unit, a first retracting unit, a resistance unit, a first guiding piece and a first movable seat. By changing a relative position between the first movable seat and the first guiding piece, the position of a first slide-assistance portion of the first movable seat on the base frame can be changed. The multifunctional recumbent exercising device allows an operator to apply force to a first side or a second side of the base frame, in order to select various kinds of training modes.

In the above-mentioned patent, the resistance unit is disposed on the base frame and cannot be dismantled and moved at will. Besides, the resistance unit is not compatible with other rowing exercise machines of different specifications or other types of exercise machines, so it is not ideal for use.

SUMMARY OF THE INVENTION

In view of the above-mentioned shortcoming that the resistance unit of the conventional exercise machine cannot be mounted and dismounted at will and is not compatible with different types of exercise machines, the primary object of the present invention is to provide a resistance unit and an exercise machine having the same.

According to one aspect of the present invention, a resistance unit is provided. The resistance unit comprises a body, a power-driven resistance unit, a reel, and a cable. The power-driven resistance unit is fixed to the body. The reel is connected to an output shaft of the power-driven resistance unit. The reel is rotated along with the output shaft. The power-driven resistance unit gives a rotational resistance to the reel. The cable is connected to and coiled around the reel. The cable has a free end.

Preferably, the power-driven resistance unit is a motor or an electromagnetic brake.

Preferably, the resistance unit further comprises a control unit. The control unit is in signal communication with the power-driven resistance unit for controlling the rotational resistance output from the power-driven resistance unit.

Preferably, the body is a closed box. The power-driven resistance unit and the reel are located in the closed box. The cable passes through an aperture of the closed box. The free end of the cable is located outside the closed box.

Preferably, the closed box has a pedal portion for a user's foot to step thereon.

Preferably, a slide-assistance member is fixed at the aperture. The cable passes through the slide-assistance member. The slide-assistance member is a sleeve or a pulley.

Preferably, the closed box is composed of a casing and a base. The aperture is disposed on a surface of the casing.

Preferably, the power-driven resistance unit is electrically connected to a power supply terminal and a power switch. The power supply terminal and the power switch are exposed on the casing. The power supply terminal is configured for connecting a mains power supply to supply power for running the power-driven resistance unit. The power switch is configured for switching on/off the power-driven resistance unit.

Preferably, a force-applying member is detachably connected to the free end of the cable to obtain the rotational resistance. The force-applying member is configured for applying a pulling force to overcome the rotational resistance.

According to another aspect of the present invention, an exercise machine having the foregoing resistance unit is provided. The exercise machine comprises at least one exercise machine frame. The resistance unit is detachably connected to the exercise machine frame.

According to the above technical features, the present invention has the following advantages:

1. The resistance unit has the advantages of being small in size and light in weight, taking up less space and being easy to carry around. In particular, the resistance unit can be used alone for fitness purposes in a small space.
2. The resistance unit is detachably connected to at least one exercise machine frame. The resistance unit may be applied to a variety of fitness equipment, including rowing exercise machines and other exercise machines.
3. The disassembly of the resistance unit is quite simple and easy. The resistance unit can be dismantled, moved and mounted to any different exercise machine.
4. The modular structure of the resistance unit is particularly suitable for mass production in factories and facilitates subsequent maintenance or replacement services.

DESCRIPTION OF THE PREFERRED EMBODIMENTS

Embodiments of the present invention will now be described, by way of example only, with reference to the accompanying drawings.

Figure 1:
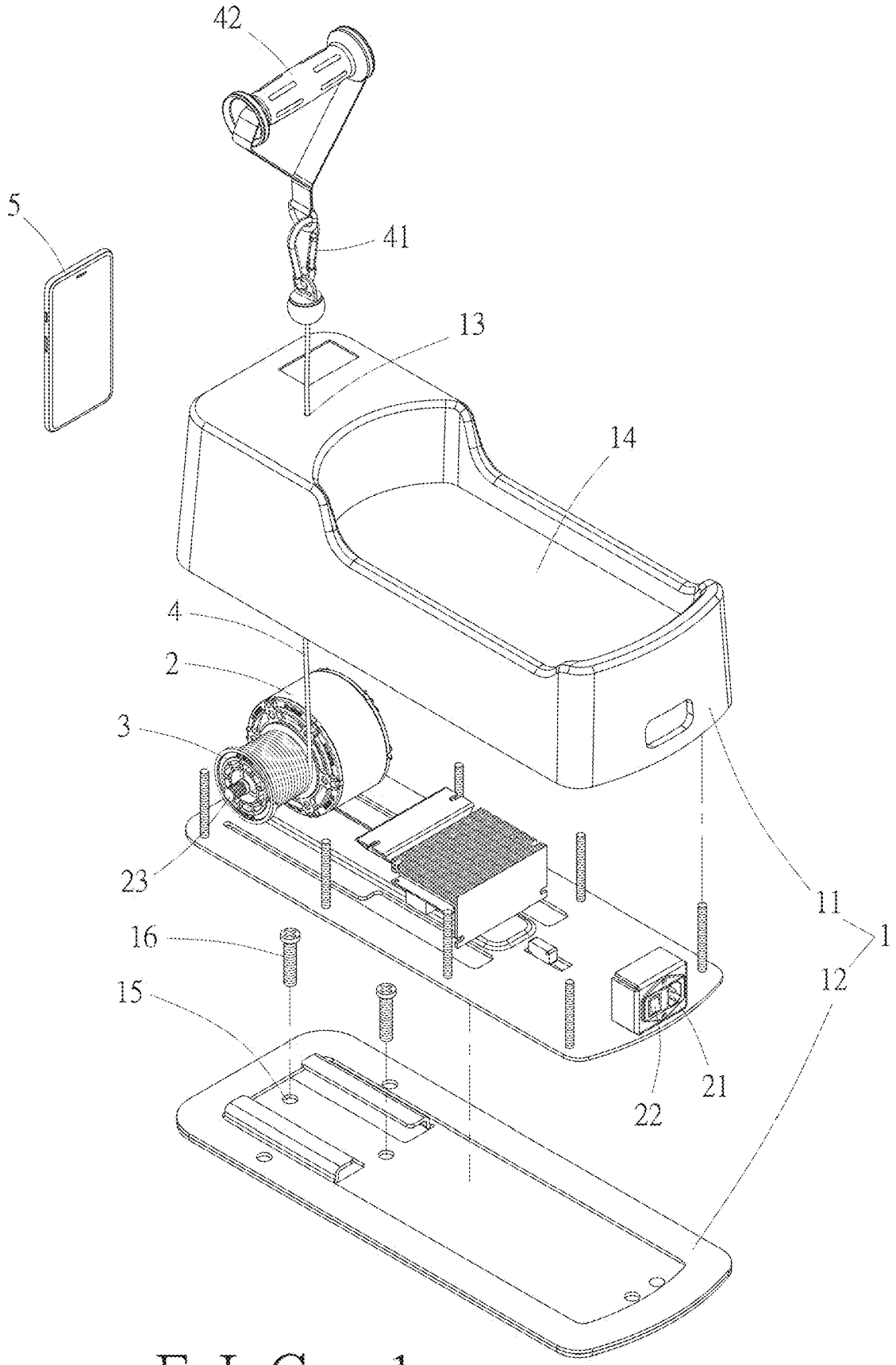
FIG. 1 is an exploded view according to a first embodiment of the present.
Figure 2:
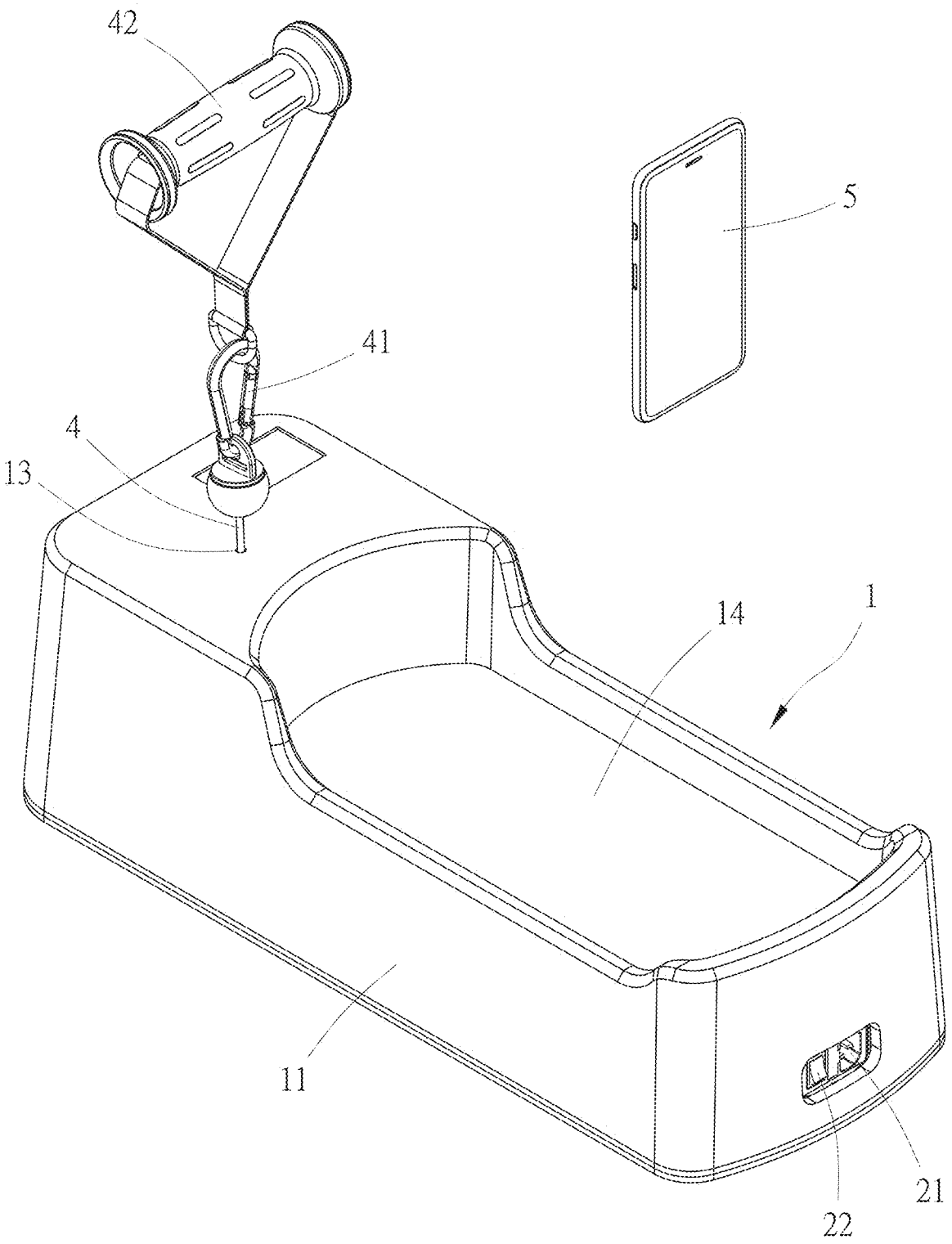
FIG. 2 is a perspective view according to the first embodiment of the present.
Figure 3:
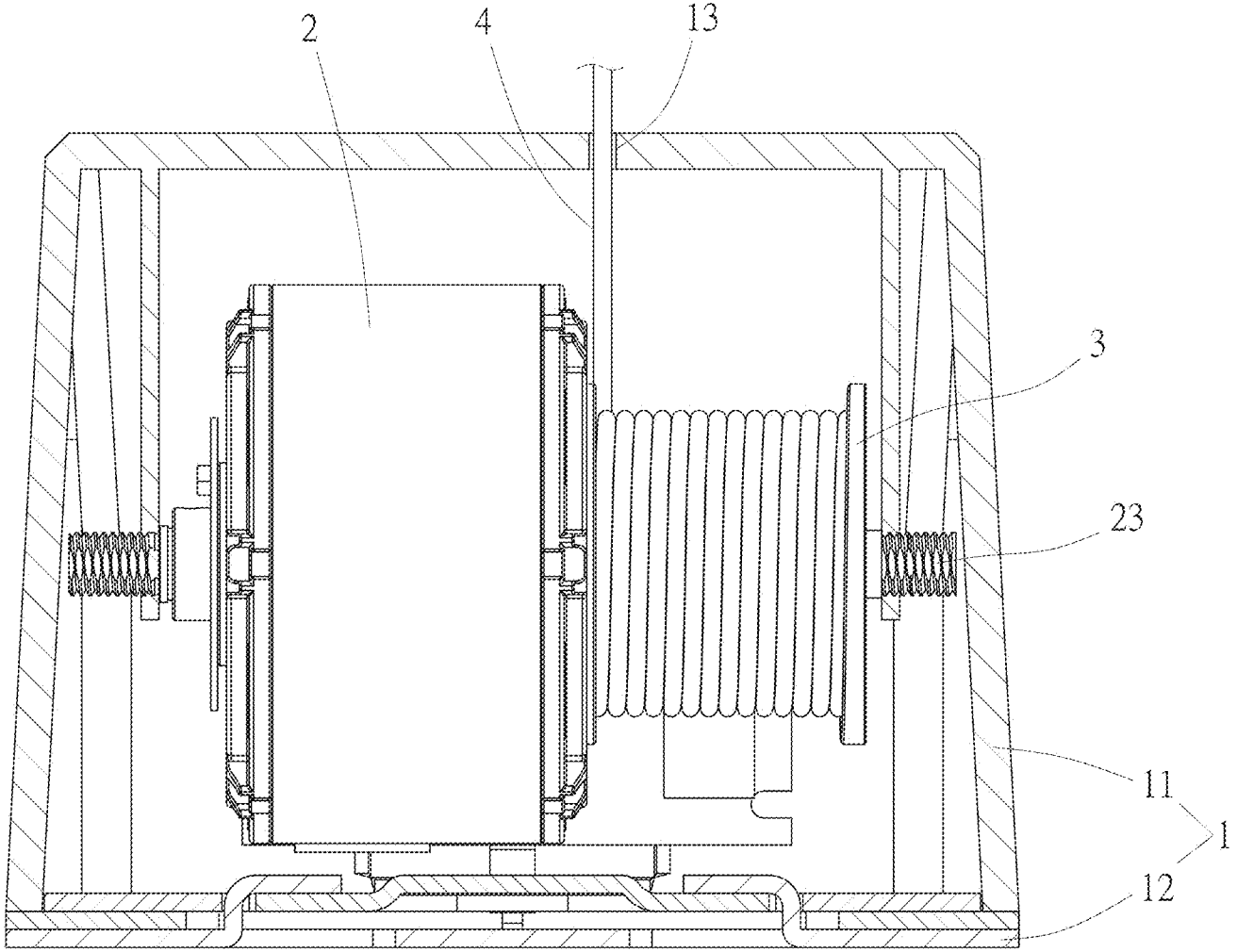
FIG. 3 is a sectional view according to the first embodiment of the present.

As shown in FIG. 1, FIG. 2 and FIG. 3, a first embodiment of the present invention is a resistance unit, comprising a body 1, a power-driven resistance unit 2, a reel 3, a cable 4 and a control unit 5.

The body 1 is a closed box composed of a casing 11 and a base 12. The surface of the top of the casing 11 has an aperture 13. The top of the casing 11 has a recess defined as a pedal portion 14 for a user's foot to step thereon. The base 12 has at least one through hole 15 for a fixing member to pass through the through hole 15 for screwing fixing. The fixing member is a bolt 16. The fixing member may be a magnet for a magnetic connection or an engaging block for a snap-fit connection, which is one of the possible implementations of the present invention.

The power-driven resistance unit 2 is fixed to the body 1. The power-driven resistance unit 2 is a motor or an electromagnetic brake. The power-driven resistance unit 2 is located in the closed box. In the embodiment of the present invention, the power-driven resistance unit 2 is electrically connected to a power supply terminal 21 and a power switch 22. The power supply terminal 21 and the power switch 22 are both exposed on one side of the casing 11. The power supply terminal 21 is configured for connecting a mains power supply to supply power for running the power-driven resistance unit 2. The power switch 22 is configured for switching on/off the power-driven resistance unit 2. The power-driven resistance unit 2 includes an output shaft 23 for transmitting power.

The reel 3 is connected to the output shaft 23 of the power-driven resistance unit 2. The reel 3 is located in the closed box. The reel 3 is rotated along with the output shaft 23. The power-driven resistance unit 2 gives a rotational resistance to the reel 3.

The cable 4 is connected to and coiled around the reel 3. The cable 4 has a free end 41. The cable 4 passes through the aperture 13 of the closed box. The free end 41 is located outside the closed box and connected to a force-applying member 42. The force-applying member 42 may be in the form of a grip ring, a grip, or a grip band. The force-applying member 42 is detachably connected to the free end 41 to obtain the rotational resistance. The force-applying member 42 is configured for applying a pulling force to overcome the rotational resistance.

The control unit 5 is in signal communication with the power-driven resistance unit 2 for controlling the rotational resistance output from the power-driven resistance unit 2. The control unit 5 is a mobile phone or a control panel, thereby automatically controlling the magnitude of the rotational resistance output from the power-driven resistance unit 2. The control panel (not shown in the figures) may be fixed on the surface of the body 1.

Figure 4:
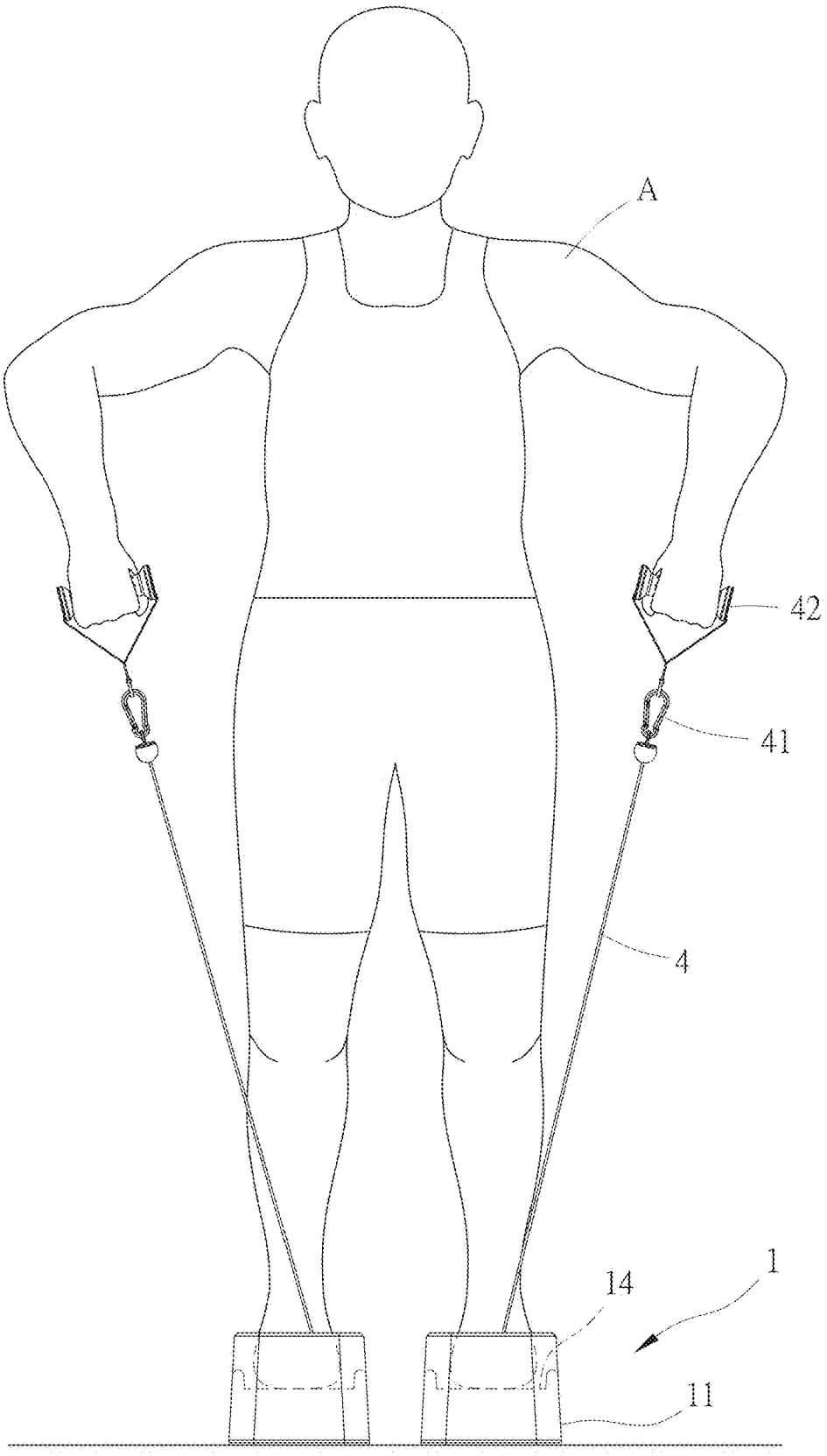
FIG. 4 is a schematic view according to the first embodiment of the present when in use.

Referring to FIG. 1, FIG. 2 and FIG. 4, when in use, the magnitude of the rotational resistance output from the power-driven resistance unit 2 may be preset through the control unit 5. The feet of the user A step on the pedal portions 14 of the tops of the casings 11 of two bodies 1, respectively. Alternatively, one foot of the user A steps on the pedal portion 14 of the top of the casing 11 of a single body 1. This can be implemented using two bodies 1 at the same time or using only one body 1. Then, either hand of the user A holds the force-applying member 42 at the free end 41 of the cable 4. The force-applying member 42 is in the form of a grip ring. The weight of the user A prevents the two bodies 1 from displacement. Both hands of the user A take turns to pull the force-applying member 42 up and down, thereby applying a pulling force to overcome the rotational resistance output from the output shaft 23 of the power-driven resistance unit 2 for fitness training.

Figure 5:
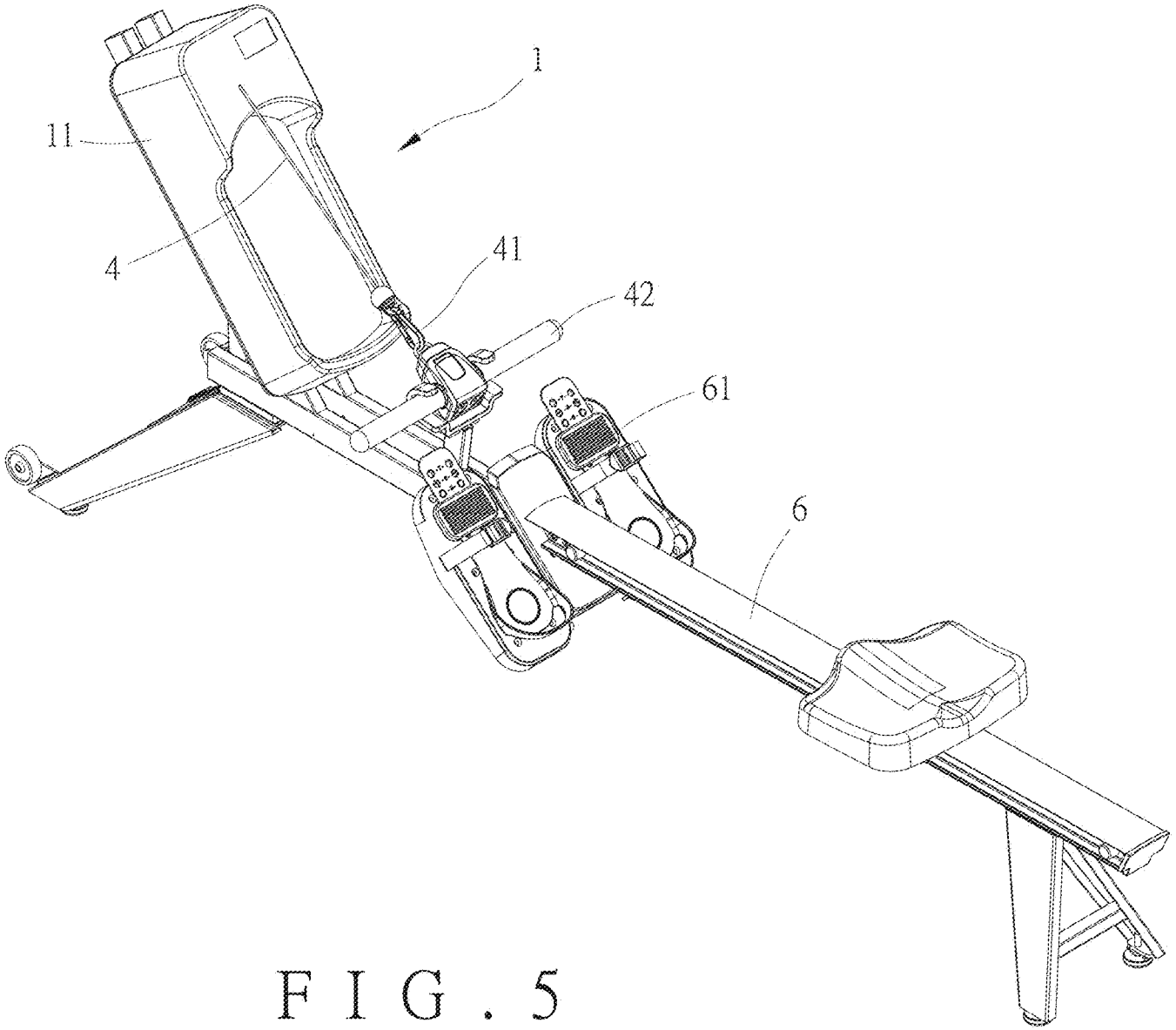
FIG. 5 is a schematic view according to a second embodiment of the present mounted to a rowing exercise machine.
Figure 6:
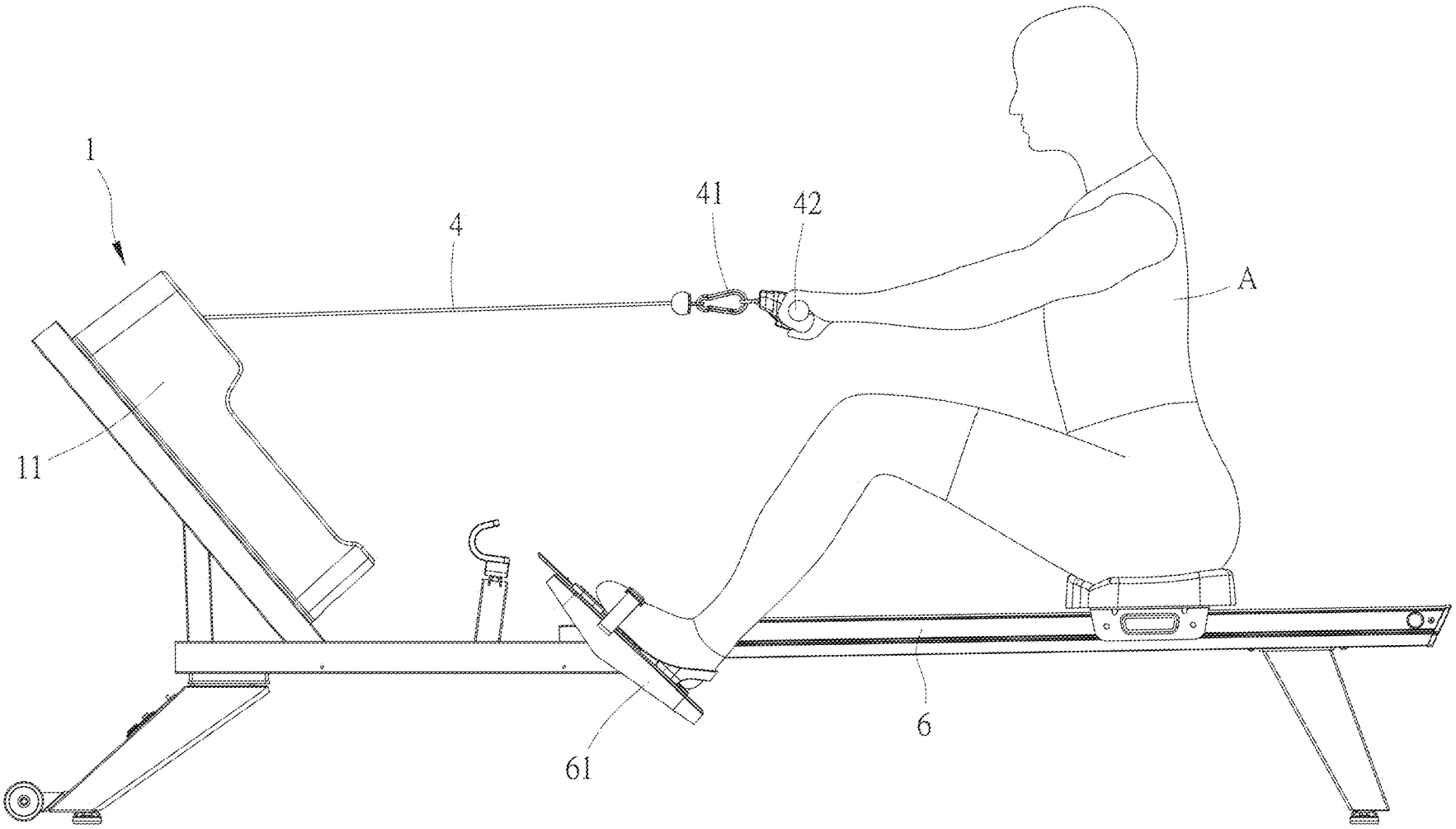
FIG. 6 is a schematic view according to the second embodiment of the present mounted to the rowing exercise machine when in use.

Referring to FIG. 1, FIG. 3 and FIG. 5, the second embodiment of the present invention is an exercise machine having the resistance unit of the first embodiment. The resistance unit is detachably connected to at least one exercise machine frame 6 by means of a screw connection, magnetic connection, or snap-fit connection. The exercise machine frame 6 is a rowing exercise machine. The resistance unit is screwed to the exercise machine frame 6 with the bolt 16 passing through the through hole 15 of the base 12 for the user to do rowing exercise. The magnitude of the rotational resistance output from the power-driven resistance unit 2 may be preset through the control unit 5. As shown in FIG. 6, both feet of the user A step on pedals 61 of the rowing exercise machine, respectively. Then, both hands of the user A hold the force-applying member 42 at the free end 41 of the cable 4. The force-applying member 42 is in the form of a grip. Both hands of the user A pull the force-applying member 42 back and forth, thereby applying a pulling force to overcome the rotational resistance output from the output shaft 23 of the power-driven resistance unit 2 for fitness training.

Figure 7:
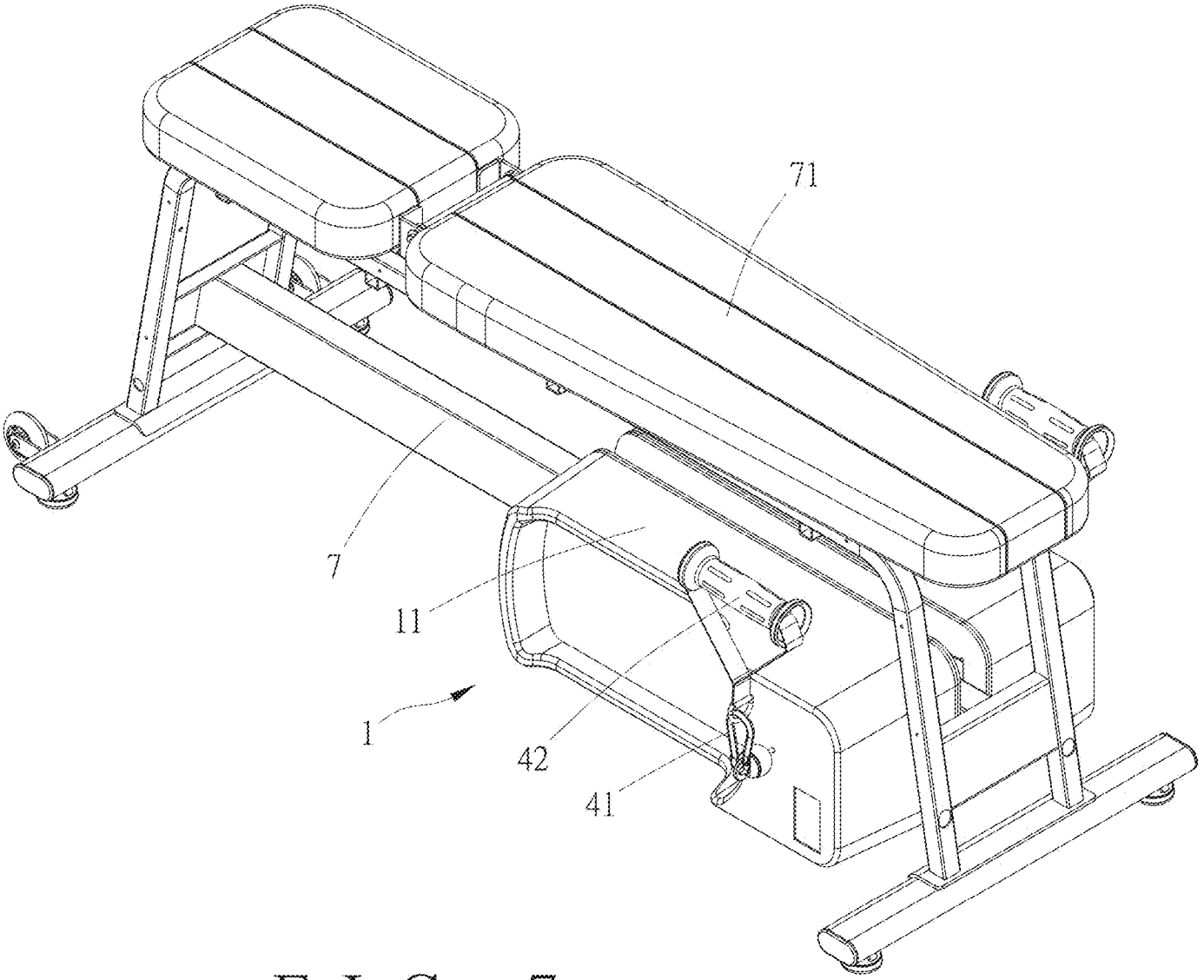
FIG. 7 is a schematic view according to a third embodiment of the present mounted to an exercise machine.
Figure 8:
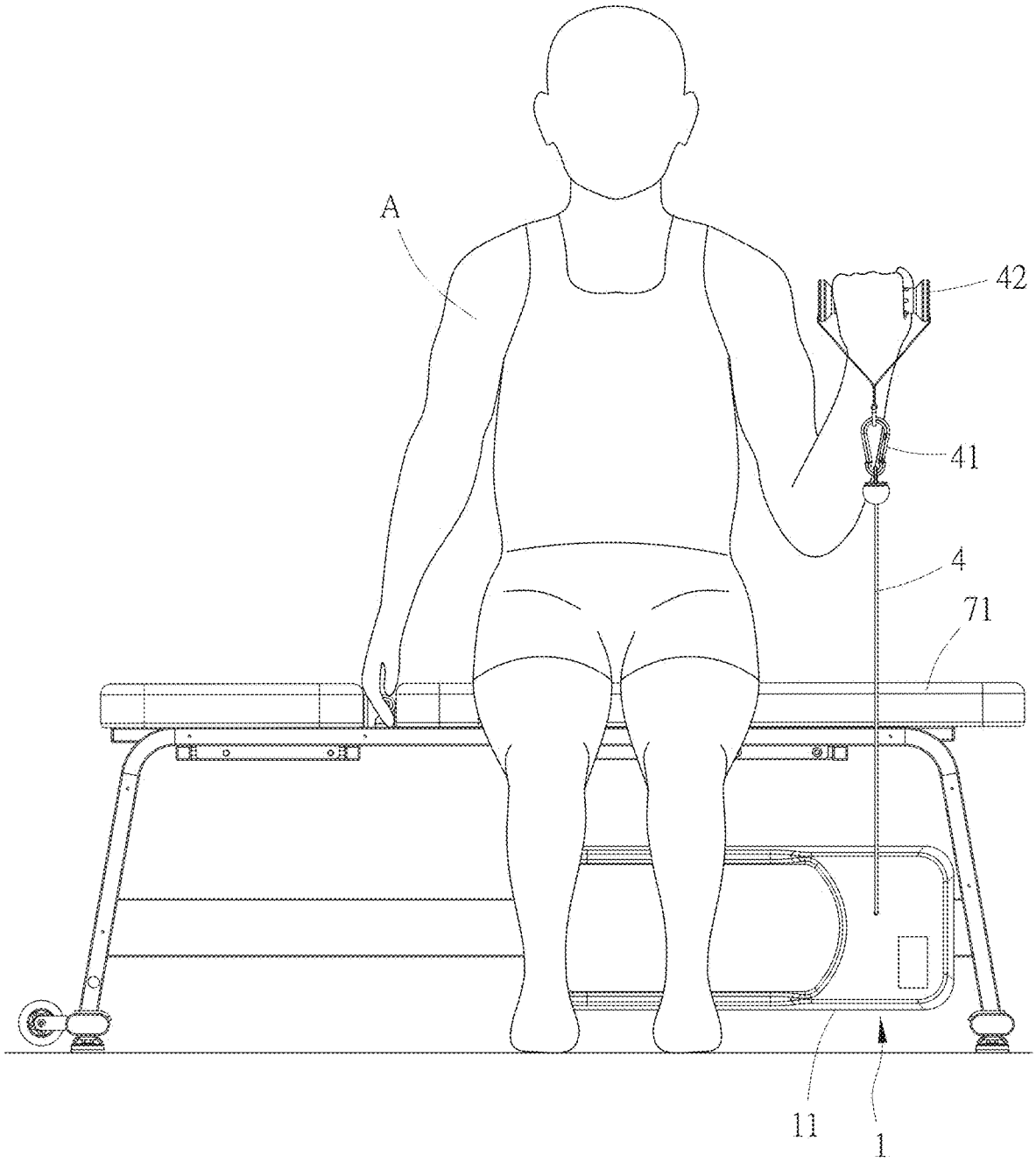
FIG. 8 is a schematic view according to the third embodiment of the present mounted to the exercise machine when in use.

Referring to FIG. 1, FIG. 3 and FIG. 7, the third embodiment of the present invention is an exercise machine having the resistance unit of the first embodiment. The resistance unit is detachably connected to at least one exercise machine frame 7 by means of a screw connection, magnetic connection, or snap-fit connection. The exercise machine frame 7 is an exercise machine. The resistance unit is screwed to the exercise machine frame 7 with the bolt 16 passing through the through hole 15 of the base 12 for the user to do exercise. The magnitude of the rotational resistance output from the power-driven resistance unit 2 may be preset through the control unit 5. As shown in FIG. 8, when in use, the user A may sit or lie on a pad 71 of the exercise machine frame 7. Then, either hand of the user A holds the force-applying member 42 at the free end 41 of the cable 4. The force-applying member 42 is in the form of a grip ring. Both hands of the user A take turns to pull the force-applying member 42 up and down, thereby applying a pulling force to overcome the rotational resistance output from the output shaft 23 of the power-driven resistance unit 2 for fitness training.

Figure 9:
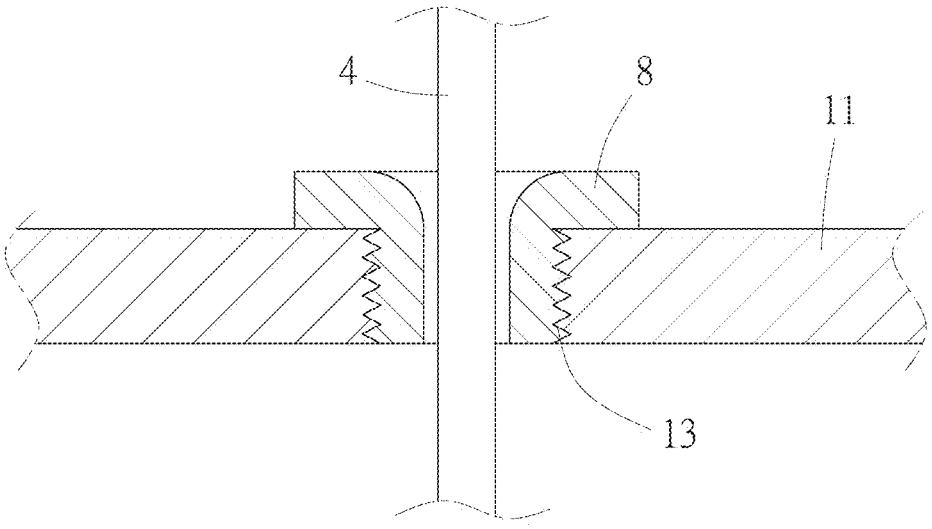
FIG. 9 is a partial sectional view according to the embodiments of the present, wherein the slide-assistance member is a sleeve.

Referring to FIG. 9, in the above embodiments of the present invention, a slide-assistance member is threadedly connected to the inner wall of the aperture 13 of the casing 11. The slide-assistance member may be a sleeve 8. The sleeve 8 is configured to minimize frictional resistance when the cable 4 is pulled out of the aperture 13 to avoid damage or breakage of the cable 4.

Figure 10:
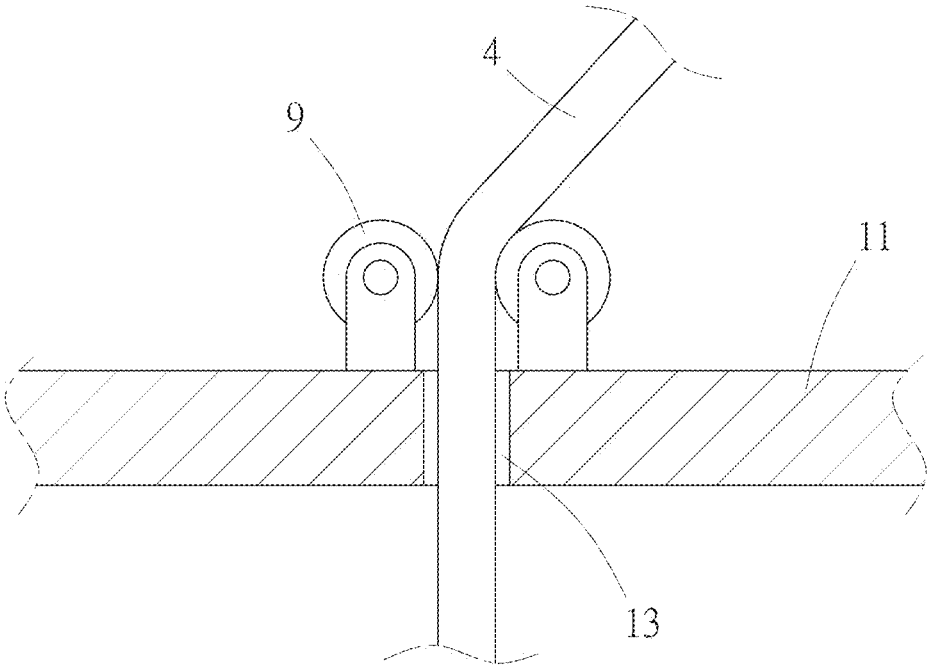
FIG. 10 is a partial sectional view according to the embodiments of the present, wherein the slide-assistance member is a pulley.

Referring to FIG. 10, in the above embodiments of the present invention, a slide-assistance member is threadedly connected to the inner wall of the aperture 13 of the casing 11. The slide-assistance member may be a pulley 9. The pulley 9 is configured to minimize frictional resistance when the cable 4 is pulled out of the aperture 13 to avoid damage or breakage of the cable 4.

The resistance unit of the present invention has the advantages of being small in size and light in weight, taking up less space and being easy to carry around. In particular, it can be used alone for fitness training. Furthermore, the resistance unit may be detachably connected to at least one exercise machine frame. The resistance unit may be applied to a variety of fitness equipment, including rowing exercise machines and other exercise machines. The assembly and disassembly of the resistance unit is easy. The resistance unit can be mounted to and dismounted from any exercise machine. The modular structure of the resistance unit is particularly suitable for mass production in factories and facilitates subsequent maintenance or replacement services.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A resistance unit, comprising: body comprising a closed box having a front end, a rear end, and an upper surface extending from the front end to the rear end, the closed box having a recessed pedal portion extending from the rear end towards the front end in the upper surface, the pedal portion being configured for a single foot of a user to step therein while the user faces the front end of the body;

a power-driven resistance unit disposed within the front end of the closed box forward of the recessed pedal portion in a longitudinal direction;

a reel, connected to an output shaft of the power-driven resistance unit, the reel being rotated along with the output shaft, the power-driven resistance unit giving a rotational resistance to the reel; and a cable, connected to and coiled around the reel, the cable having a free end extending through an aperture through the upper surface at the front end of the closed box.

2. The resistance unit as claimed in claim 1, wherein the power-driven resistance unit is one of a motor and an electromagnetic brake.

3. The resistance unit as claimed in claim 1, further comprising a control unit, wherein the control unit is in signal communication with the power-driven resistance unit for controlling the rotational resistance output from the power-driven resistance unit.

4. The resistance unit as claimed in claim 1, wherein a slide-assistance member is fixed at the aperture, the cable passes through the slide-assistance member, and the slide-assistance member is one of a sleeve and a pulley.

5. The resistance unit as claimed in claim 1, wherein the closed box comprises a casing and a base, and the aperture is formed through the surface of the casing.

6. The resistance unit as claimed in claim 1, wherein the power-driven resistance unit is electrically connected to a power supply terminal and a power switch, the power supply terminal and the power switch are exposed on a casing of the body, the power supply terminal is configured for connecting a mains power supply to supply power for running the power-driven resistance unit, and the power switch is configured for switching on/off the power-driven resistance unit.

7. The resistance unit as claimed in claim 1, wherein a force-applying member is detachably connected to the free end of the cable to obtain the rotational resistance, and the force-applying member is configured for applying a pulling force to overcome the rotational resistance.

8. An exercise machine comprising:

the resistance unit as claimed in claim 1; and at least one exercise machine frame, wherein the resistance unit is detachably connected to the exercise machine frame.

9. The exercise machine as claimed in claim 8, wherein the power-driven resistance unit is one of a motor and an electromagnetic brake.

10. The exercise machine as claimed in claim 8, further comprising a control unit, wherein the control unit is in signal communication with the power-driven resistance unit for controlling the rotational resistance output from the power-driven resistance unit.

11. The exercise machine as claimed in claim 8, wherein a slide-assistance member is fixed at the aperture, the cable passes through the slide-assistance member, and the slide-assistance member is one of a sleeve and a pulley.

12. The exercise machine as claimed in claim 8, wherein the wherein the closed box comprises a casing and a base, and the aperture is formed through the surface of the casing.

13. The exercise machine as claimed in claim 8, wherein the power-driven resistance unit is electrically connected to a power supply terminal and a power switch, the power supply terminal and the power switch are exposed on a casing of the body, the power supply terminal is configured for connecting a mains power supply to supply power for running the power-driven resistance unit, and the power switch is configured for switching on/off the power-driven resistance unit.

14. The exercise machine as claimed in claim 8, wherein a force-applying member is detachably connected to the free end of the cable to obtain the rotational resistance, and the force-applying member is configured for applying a pulling force to overcome the rotational resistance.

* * * * *